United States Patent [19]

Cannata

[11] Patent Number: 4,683,623

[45] Date of Patent: Aug. 4, 1987

[54] POSITIVE INTERCONNECT SYSTEM

[76] Inventor: Joseph M. Cannata, 646 Gloucester Dr., Highland Heights, Ohio 44143

[21] Appl. No.: 918,475

[22] Filed: Oct. 14, 1986

[51] Int. Cl.[4] ..... F24B 7/00

[52] U.S. Cl. ..... 126/123; 126/120; 126/318; 126/126

[58] Field of Search ..... 126/120, 121, 123, 126, 126/307 R, 314, 315, 318

[56] References Cited

U.S. PATENT DOCUMENTS

| | | | |
|---|---|---|---|
| 964,642 | 7/1910 | Hall | 126/318 |
| 1,455,027 | 5/1923 | Ludwig | 126/307 R |
| 2,791,213 | 5/1957 | Goulding | 126/123 |
| 2,808,825 | 10/1957 | Solomon | 126/307 R |
| 2,918,053 | 12/1959 | Epstein | 126/307 R |
| 4,026,264 | 5/1977 | Henriques | 126/123 |
| 4,207,862 | 6/1980 | Meyer | 126/123 X |
| 4,306,491 | 12/1981 | Reardon | 126/126 X |
| 4,385,623 | 5/1983 | Jacklich | 126/126 |
| 4,422,439 | 12/1983 | Hunt | 126/123 |
| 4,424,794 | 1/1984 | Page | 126/123 |
| 4,527,541 | 7/1985 | Roberts | 126/123 |
| 4,584,986 | 4/1986 | Cannata | 126/123 |

FOREIGN PATENT DOCUMENTS

| | | |
|---|---|---|
| 23285 | 12/1882 | Fed. Rep. of Germany . |
| 3013744 | 10/1981 | Fed. Rep. of Germany . |

*Primary Examiner*—Margaret A. Focarino

*Attorney, Agent, or Firm*—Renner, Kenner, Greive, Bobak & Taylor

[57] ABSTRACT

A positive interconnect system (10) embodying the concepts of the present invention provides a sealed passageway between a fireplace insert (11) and a liner (12) in the flue (13) of a chimney (14). An oval connector (46) and a transitional connector (48) are each constructed with an overall depth dimension such that they may be individually inserted through the opening (29) in a damper frame (21) and into the smoke chamber (28) of the chimney (14). After the connectors (46, 48) are received within the smoke chamber (28) they may be joined together by an interlock (49) to form a composite connector assembly (45). The assembly (45) is then fastened to the uppermost end (95) of a flexible duct (40), and the assembly (45) is then moved upwardly through the smoke chamber (28) into sealing engagement with the flue liner (12). Post means (111, 112) support the assembly (45) in sealing engagement with the flue liner (12). The lowermost end (110) of the flexible duct (40) is operatively connected to an insert connector (35), and the insert connector is secured to the insert (11) by a selection of inside or outside fastener means (135 or 136). The insert connector (35) is provided with a boot (120) that is adjustably positionable with respect to the frame (121) of the insert connector (35).

32 Claims, 12 Drawing Figures

POSITIVE INTERCONNECT SYSTEM

TECHNICAL FIELD

The present invention relates generally to positive interconnect arrangements for fireplace inserts. More particularly, the present invention relates to a positive interconnect system that provides a closed communication passage between the fireplace insert and the lowermost liner in the flue of the chimney. Specifically, the present invention relates to a positive interconnect system that passes from the fireplace insert, through the damper opening as well as the smoke chamber and upwardly to the flue liner in order to effect a closed and sealed passageway between the fireplace insert and the flue liner without being connected to, and without being supported from, the damper frame.

BACKGROUND OF THE INVENTION

The advent of central heating relegated the fireplace to a decorator's item. The relatively recently recognized reality regarding the long term uncertainty of the quality and cost of fossil fuels has necessitated a rethinking as to how the fireplace might be employed as at least a supplemental heat source.

The heat emanating from the fireplace may warm those sitting in close proximity thereto, and its radiant energy may tend to warm the immediate room, but the operating fireplace induces an air flow which reduces the overall heating efficiency of the primary heat source. So long as the fireplace is operating there is an endless trail of warm, expensive, household air racing up the chimney. For years no one objected. Energy to operate the central heating system was available in abundance, and at relatively low cost.

Gradually it became apparent that the world's fuel supplies do not issue forth from a cornucopia; rather, the supply is finite; some fuels, such as wood, can be replenished if its source is carefully husbanded, but overall the cost of fossil fuels has continued to rise. By the early 1970s the crunch was widely felt.

Many people boarded up their fireplaces; some closed and sealed the dampers to their fireplaces; and, others judiciously operated their fireplaces only on those days when the resultant overall loss of heat would not be sorely felt. This latter approach created the paradox of not being able to use the fireplace on truly cold days.

It is estimated that there are currently in excess of twenty million fireplaces in the United States, and with that available market the fireplace insert was developed. The fireplace insert converts the outmoded fireplace into a valuable, secondary heat source and still permits man the luxury of fulfilling the primordial instinct of watching a crackling fire while basking in its cozy warmth.

Currently, manufacturers are providing fireplace inserts in a wide variety of models. Initially, a self contained firebox was simply inserted into the old fireplace opening, and a shroud was was fitted between the insert and the facing of the original fireplace opening to minimize the undesirable exiting flow of warm air from within the home. However, this arrangement has two major drawbacks. Not only is an effective seal between the insert and the fireplace opening virtually impossible to effect, but such an arrangement inherently exposes the exhaust gases to an excessive surface area which serves to cool the exhaust gases, allowing them to condense and deposit creosote within the old fireplace as well as upwardly along the interior of the the chimney. Creosote deposits are a natural fire hazard and must be avoided.

Both drawbacks can be greatly minimized by the use of a positive interconnect system that extends between the exhaust vent of the fireplace insert and the flue liner in the chimney. Such positive interconnect systems, or at least portions thereof, have been employed, but they have heretofore been rather difficult to install and, if effective, have been sufficiently complicated as to be fairly costly.

Some of the more popular interconnect systems effect a positive connection only between the fireplace insert and the damper. In addition, however, it is highly desirable to provide a direct, enclosed flow path from the damper to the flue liner in the chimney. A smoke chamber is normally provided between the damper and the flue of the chimney, and the inclusion of an enclosed flow path therethrough can eliminate any tendency for creosote to be deposited on the walls of the smoke chamber. The enclosed flow path from the damper to the flue also tends to maintain a higher flue temperature, which serves to increase the draft action of the chimney, thereby further improving the performance of the insert.

The use of flexible, oval ducting has been widely suggested to effect the enclosed flow path between at least the damper and the flue liner, and while such an arrangement is not only theoretically quite effective but also very attractive in artists' renditions employed in sales brochures, the actual installation requires that such flexible ducting be bent in a generally S-shaped curve during installation. Chimney dimensions and layouts are not standard, and that precludes pre-shaping the ducting. In fact, the majority of chimney layouts even prevent the ducting from being shaped prior to insertion. As a result, the person who installs the flexible, oval ducting must attempt to bend the ducting after it has been at least partially inserted through the damper, and it must be appreciated that the person doing the work is then attempting to bend that portion already inserted. This is a difficult task, at best, and virtually impossible in some chimneys because of their interior configuration.

SUMMARY OF THE INVENTION

It is, therefore, a primary object of the present invention to provide an improved, positive interconnect system between the fireplace insert and flue liner of the chimney.

It is another object of the present invention to provide a positive interconnect system, as above, that can be readily installed between a fireplace insert and the flue liner in most any chimney.

It is a further object of the present invention to provide a positive interconnect system, as above, that employs a flexible, oval duct.

It is an even further object of the present invention to provide a positive interconnect system, as above, that is relatively inexpensive to manufacture and which can be inserted with a minimal number of standard hand tools and, to facilitate installation of the flexible, oval duct, one additional special tool.

It is yet another object of the present invention to provide a positive interconnect system, as above, that can be readily adapted to accommodate a wide variation of chimney dimensions and layouts.

It is a still further object of the present invention to provide a unique method of installing a positive interconnect system, as above.

These and other objects of the present invention, as well as the advantages thereof over existing and prior art forms, will be apparent in view of the following detailed description of the attached drawings and are accomplished by means hereinafter described and claimed.

In general, a positive interconnect embodying the concept of the present invention may be employed to effect a closed system whereby to communicate between the exhaust vent of a fireplace insert and the lowermost extent of the liner in the flue of a chimney, which flue liner normally terminates upwardly of the smoke chamber in the chimney. The components of the system that are located in the smoke chamber must be of such configuration that they can be readily inserted through the damper opening.

As such, the present invention employs not only an oval connector that can be inserted through the restricted opening of a damper but also a transitional connector that can be similarly inserted through the damper opening. When both components are thus received within the smoke chamber they can be joined by an interlock to form a composite connector assembly.

A flexible duct can be secured to the composite connector assembly, and the composite connector assembly can then be moved upwardly, through the smoke chamber, sealingly to engage the flue liner. Post means engage the composite connector assembly and rest against some structural member incorporated within the chimney itself, such as the frame of the damper, to maintain the composite connector assembly in sealed engagement with the flue liner.

The lower end of the flexible duct communicates with an insert connector that, in turn, communicates with the exhaust vent of the fireplace insert. Fastener means are provided to secure the insert connector to the insert.

A method for installing a positive interconnect system embodying the concept of the present invention provides for sequential insertion of the oval and transitional connectors through the damper opening and then connecting the two individual connectors together as a composite connector assembly. So conjoined, the resulting composite connector is secured to one end of a flexible duct, and the duct is inserted through the damper opening until the composite connector sealingly engages the flue liner of the chimney.

When the composite connector assembly thus seals against the flue liner, one or more post means are employed to maintain the sealed engagement of the composite connector against the flue liner. The other end of the flexible duct still protrudes from the damper opening, and that end is operatively connected to an insert connector, which is, in turn, secured to the fireplace insert.

One preferred embodiment of the present invention, together with an alternative variation as to the fastener means by which the insert connector is secured to the insert itself, are shown by way of example in the accompanying drawings without attempting to show all of the various forms and modifications in which the invention might be embodied; the invention being measured by the scope of the appended claims and not by the details of the specification.

DESCRIPTION OF AN EXEMPLARY EMBODIMENT

Figure 1:
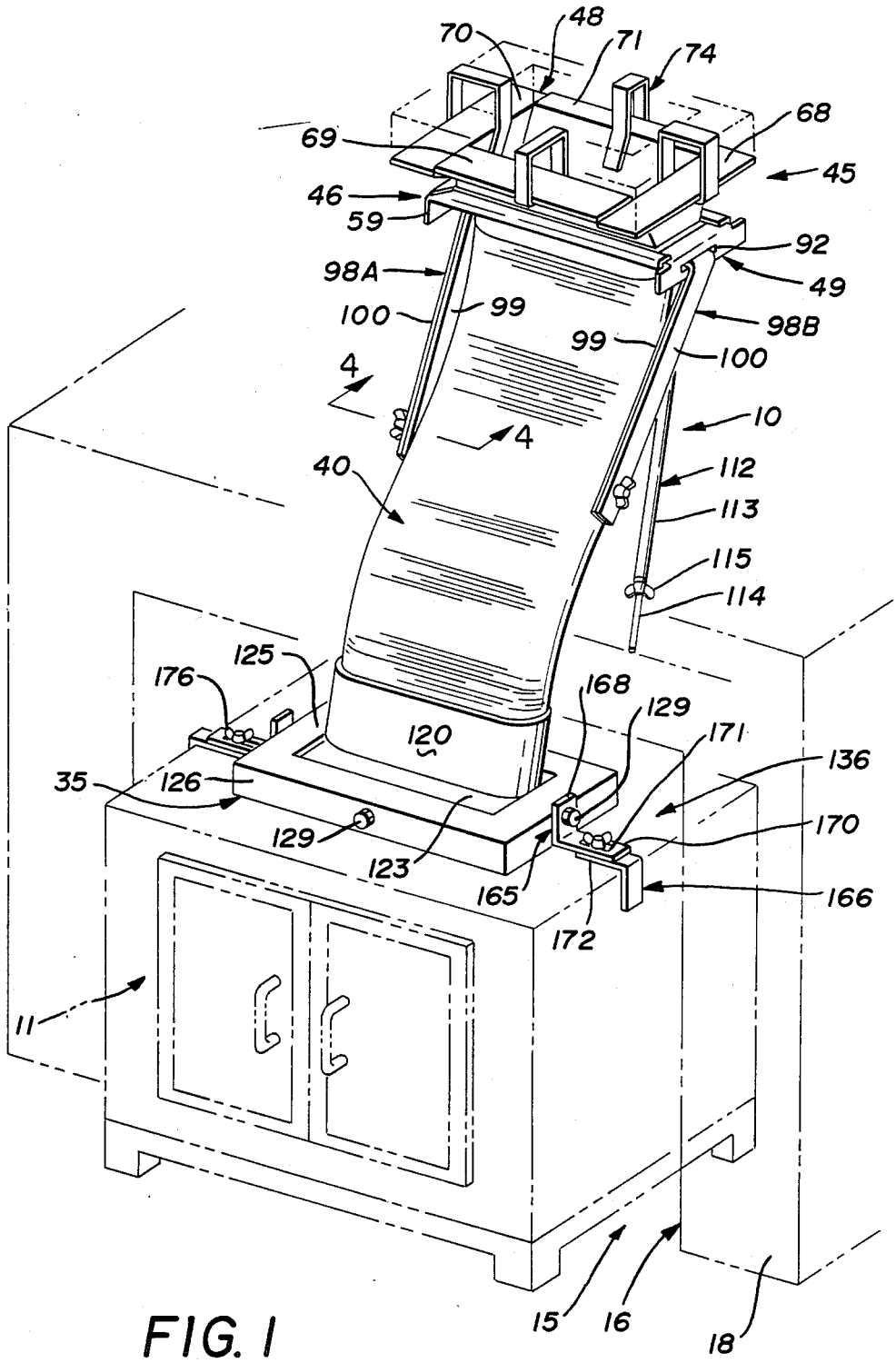
FIG. 1 is a generally frontal schematic, in perspective, depicting a positive interconnect system embodying the concept of the present invention and connected, by virtue of an external fastener, to a fireplace insert and extending upwardly therefrom, as it would when extending through the damper opening and smoke chamber toward a flue liner (not depicted)

A positive interconnect system embodying the concept of the present invention is designated generally by the numeral 10 on the attached drawings. The positive interconnect system 10 connects between a fireplace insert 11 and the liner 12 in the flue 13 of a chimney 14.

Figure 2:
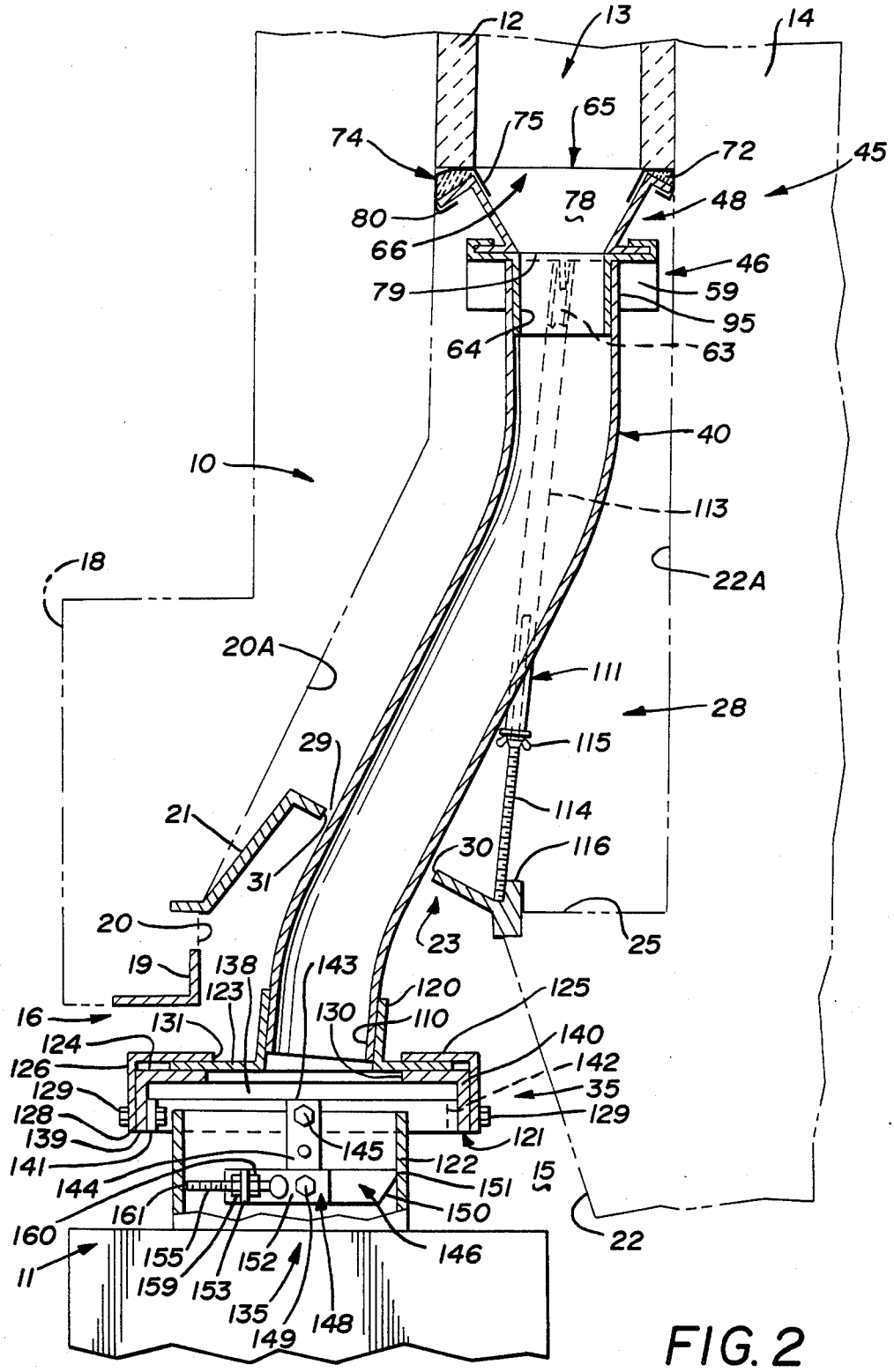
FIG. 2 is a cross section, taken along a vertical plane, and depicting a positive interconnect system embodying the concept of the present invention, in situ, as it extends from a fireplace insert connector (provided with an internal fastener), through the damper opening and the smoke chamber sealingly to engage, at its uppermost extremity, the lowermost liner in the flue of the chimney.
Figure 6:
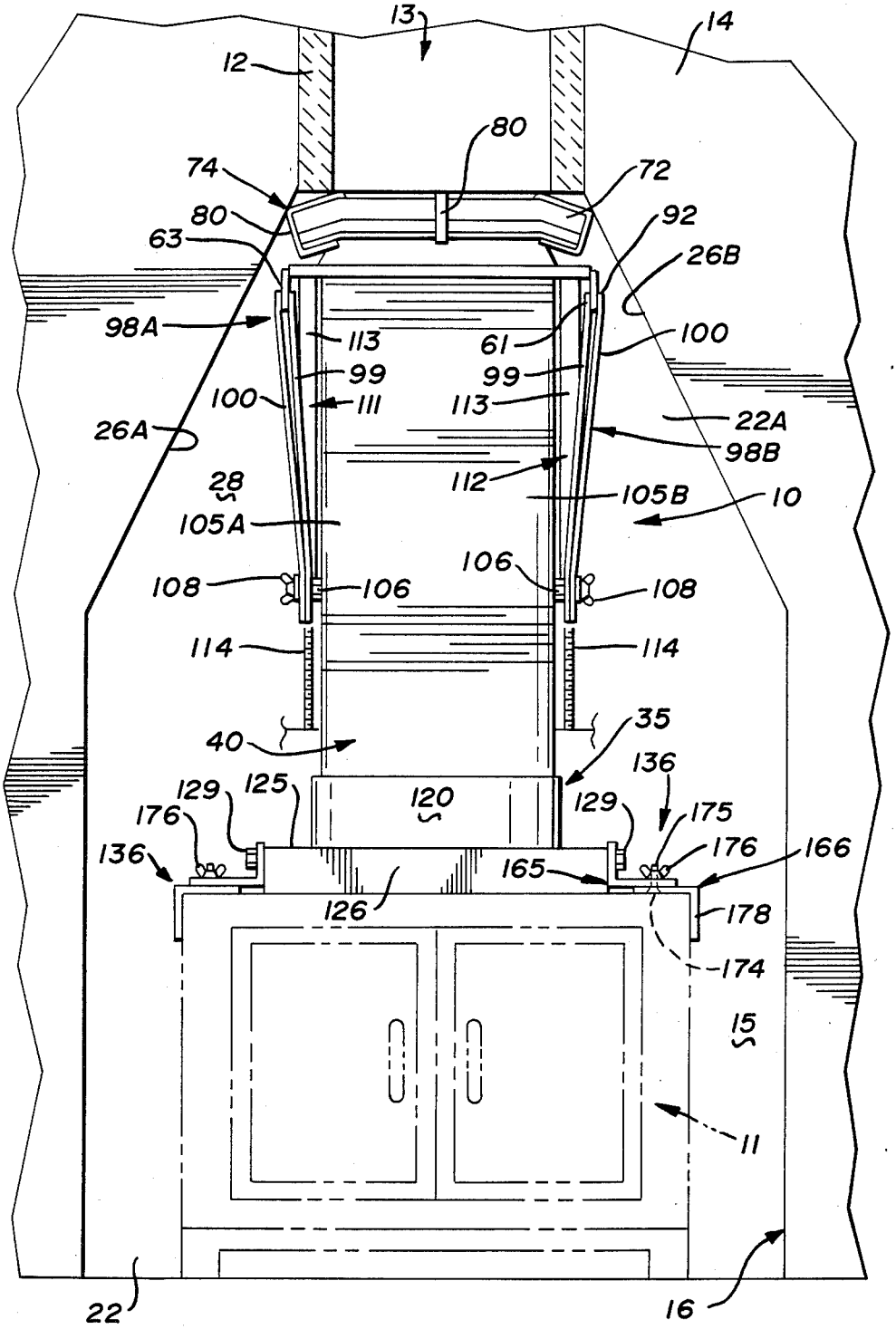
FIG. 6 is a frontal elevation of the interconnect system represented in FIG. 1 and depicted, in situ, with the fireplace and chimney broken away in order to reveal the disposition of the interconnect system more clearly in relationship to the lateral walls of the smoke chamber and the flue liner of the chimney that extends upwardly from the smoke chamber; and, FIGS. 7A–7F are schematic, vertical cross-sections through a chimney depicting, in sequence and in side elevation, the insertion and assembly of an interconnect system embodying the concepts of the present invention.

To understand the environment within which the positive interconnect system 10 is employed, and as is perhaps most clearly depicted in FIGS. 1, 2 and 6, the chimney 14 has a fireplace recess 15 surrounded by an opening 16 that may be faced (as at 18) as desired. A lintel 19, such as the angle iron depicted, spans the opening 16 and supports that portion of the facing 18 located above the opening. The recess 15 is partially bounded by a front wall 20 on the interior thereof that extends vertically upwardly from the lintel 19 to approximately the level of the damper frame 21 and then corbels, as at 20A, rearwardly and upwardly to the liner 12 within the flue 13 of the chimney 14.

The opposing, rear wall 22 on the interior of the recess 15 converges upwardly and forwardly toward the front wall 20 to define a throat 23 across which the damper frame 21 is operatively positioned. At approximately the level of the damper frame 21 the rear wall 22 abruptly recedes as a shelf 25, and then continues, as at 22A, generally vertically upwardly as the rear wall on the interior of the chimney 14. As such, the lowermost liner 12 in the flue 13 terminates in engagement with the rear wall 22A at what may be designated as the top of the hereinafter described smoke chamber 28.

In fact, the cavity within the chimney 14—defined generally by the shelf 25, the portion 20A of the front wall 20, the portion 22A of the rear wall 22 as well as the converging side walls 26A and 26B (FIG. 6) of the chimney 14—is the smoke chamber 28.

As best seen in FIG. 2, the standard damper frame 21 has an opening 29 that is inclined with respect to a horizontal frame of reference in order to permit an easily effected swing of the plate (not shown) that is employed to open and close the damper when the latter is employed in a standard fireplace—i.e., without the insert 11. The standard damper opening 29 has a minimum minor dimension, measured between the opposed edges 30 and 31 of opening 29, of slightly less than 5 inches (12.7 cm), but the major dimension, measured transversely of the minor dimension, will vary according to the width of the fireplace. The smallest standard damper readily available on the market has an opening with a major dimension of approximately 18 inches (45.72 cm). As such, the major dimension of the damper opening will always be greater than the minor dimension, and the minor dimension will, therefore, control the overall size of any object that can be successfully inserted through the damper opening 29. Accordingly, the minor dimension of damper opening 29 is critical to the size of the components that can be employed in at least that portion of a positive interconnect system 10 which extends upwardly of the damper.

Figure 3:
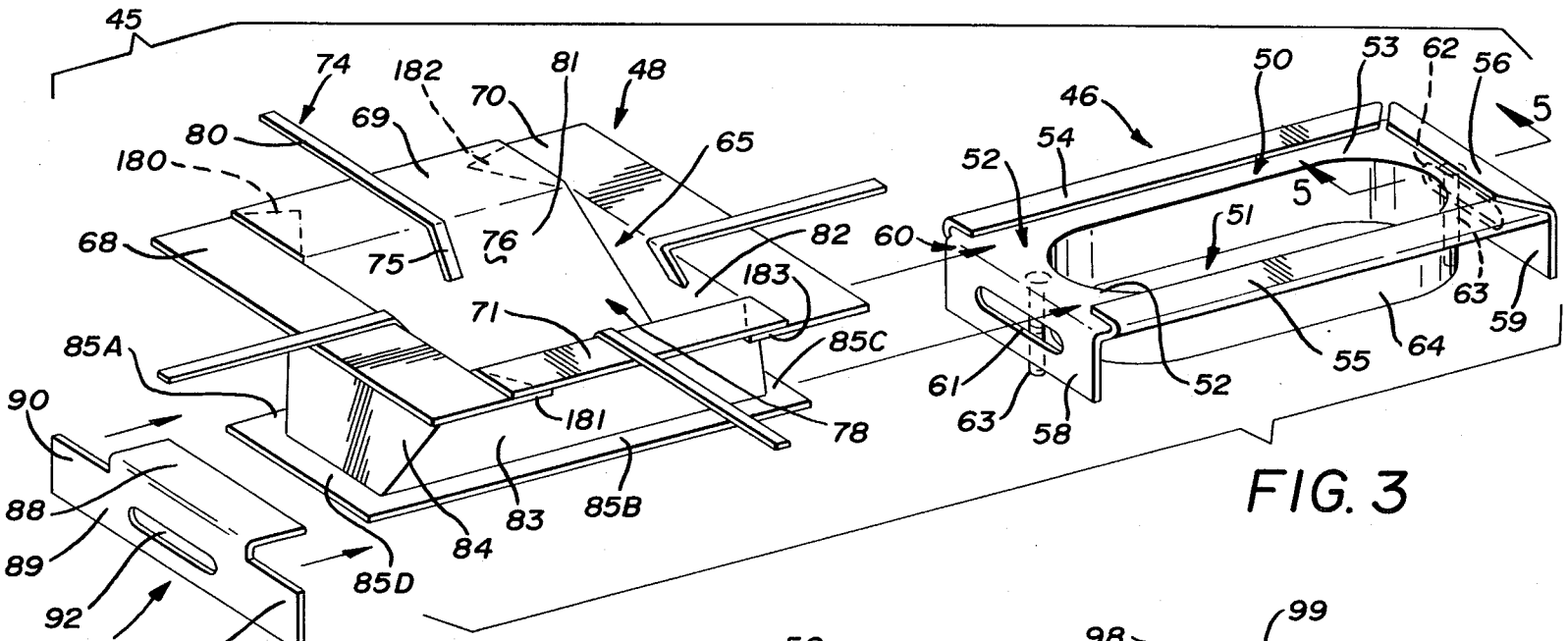
FIG. 3 is an enlarged, and exploded, perspective of those components in a positive interconnect system embodying the concepts of the present invention, as depicted in FIGS. 1 and 2, by which a sealed connection is effected between a flexible, oval duct and the lowermost liner in the flue of a chimney.

In general, a positive interconnect system 10, which embodies the concepts of the present invention, comprises an insert connector 35 by which to effect a positive connection between the insert 11 and the flexible duct 40, and a composite connector assembly 45 by which to effect a sealed engagement between the flexible duct 40 and the liner 12 in the flue 13 of chimney 14. To facilitate an understanding of the present invention those components which are perhaps most fully and clearly represented in FIG. 3 will be described in the order in which they are installed. By thus describing the components, the reader will already have acquired a preview of the installation procedure before the preferred method for the installation of a positive interconnect system 10 is actually described.

It is, therefore, appropriate to begin the description of the positive interconnect system 10 with the composite connector assembly 45. As is shown with the greatest detail in FIG. 3, the assembly 45 comprises an oval connector 46 that can be removably secured to a transitional connector 48 by virtue of an interlock 49.

The oval connector 46 has a generally planar frame portion 50 which circumscribes the oval opening 51 that penetrates the connector 46. The two lateral sides of the rectangular outer perimeter of the flat frame portion 50 present a slideway 52. Specifically, the edges along those two sides of the frame portion 50 are folded back over the upwardly directed face 53 thereof to present retaining flanges 54 and 55, each of which is disposed in spaced relation upwardly of the face 53 in order to form the slideway 52.

A stop flange 56 is formed at one end of the slideway 52, and the edge of the frame portion 50 opposite the stop flange 56 is turned downwardly to present a tie plate 58.

Figure 5:
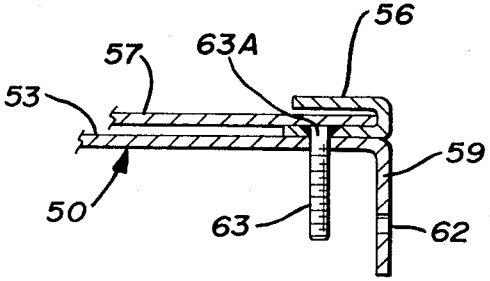
FIG. 5 is an enlarged cross section taken substantially along line 5—5 of FIG. 3 and appearing on the same sheet of drawings as FIGS. 3 and 4.

It is a matter of choice as to whether the stop flange 56 is formed from a separate plate attached to the face 53 of the frame 50, as represented in FIG. 5, in which case a tie plate 59 can also be formed at that end of the slideway 52 by turning the adjacent edge of the frame portion 50 downwardly. Conversely, the stop flange 56 may be formed by appropriately folding the frame portion 50, in which case the tie plate 59 may comprise a separate piece of metal that is welded, or otherwise secured, to the oval connector 46. In either event, that end of the slideway 52 opposite the stop flange 56 presents an open, access end 60.

Generally rectangular slots 61 and 62 penetrate the tie plates 58 and 59, respectively, each for a purpose more fully hereinafter described.

An aligning pin 63, also for a purpose hereinafter more fully described, is secured through the planar frame portion 50 at each end of the oval opening 51. The head portion 63A on each aligning pin 63 is preferably a flush, rivet-type head in order that the head portion 63A will not interfere with the joinder of the connectors 46 and 48, as hereinafter more fully described, but interference by the head portions 63A to the joinder of the connectors 46 and 48 may also be obviated by securing a slide plate 57 over the entire upper surface 53 of the frame portion 50, with the head portions 63A on each pin 63 being disposed beneath the slide plate 57, as depicted in FIG. 5.

The oval opening 51 through the frame portion 50, and the slide plate 57, if employed, is itself circumscribed by an oval tube 64 that can be matingly engaged within the uppermost end of the flexible duct 40. The oval tube 64 is preferably insertable within the duct 40 so that any combustion fluid, such as creosote, or other liquid will be unimpeded in its flow downwardly through the positive interconnect system 10.

It must be appreciated, however, that to install the oval connector 46 the maximum dimension permissible for the overall depth thereof can not exceed the minor dimension of the damper opening 29, and, in fact, should be at least modestly less than the minor dimension of the damper opening in order to facilitate passage of the entire oval connector 46 through the damper opening 29.

Whereas the lateral, or major, dimension of a typical, domestic damper opening 29 may vary from approximately 18 inches (45.72 cm) to approximately 47 inches (119.38 cm), that dimension is by far the larger of the dimensions for the damper opening 29. The opening 29 measured across its front to rear incline—i.e., between the opposed edges 30 and 31—will vary from slightly less than 5 inches (12.7 cm) to an absolute maximum of approximately 9.5 inches (24.13 cm). This minor dimension, then, forms an absolute restriction on the size of any component one may insert into the smoke chamber 28 through the damper opening 29.

In order to provide universality in the sense that the oval connector 46 can be unimpededly inserted through the smallest damper opening 29 one is likely to encounter in the field, it is, therefore, preferable that the overall depth of the oval connector 46 not exceed approximately 4.5 inches (11.43 cm).

To obviate any possible misunderstanding, it should be understood that when speaking of the overall depth of the oval connector 46 that terminology is intended to signify the maximum dimension between the uppermost surface of the retaining flanges 54 and 55 (as well as the uppermost surface of the stop flange 56) and the lowermost extent of the tie plates 58 and 59, or the oval tube 64, whichever extends the furthest downwardly.

The transitional connector 48, which is intended to be releasably secured to the oval connector 46, is itself also preferably fabricated of sheet metal. Its purpose is to provide a passageway that effects a transition between the oval opening 51 through the connector 46 and the generally rectilinear flue 13 forming the interior of the liner 12.

In most residential chimneys the flue liner is of square cross-section, measuring generally 8 by 8 inches (20.23 by 20.23 cm) or 12 by 12 inches (30.48 by 30.48 cm). There are some flue liners of rectangular cross section, but if one understands the construction of the transitional connector 48 as applied to flue liners of square cross-section, that understanding will permit the present invention to be readily adapted to flue liners of rectangular cross-section.

The uppermost opening 65 of the transitional connector 48 conforms with the lowermost opening 66 of the flue liner 12. For use in conjunction with, for example, an 8 by 8 inch (20.32 by 20.32 cm) flue liner the opening 66 of the flue liner 12 would conform to those dimensions. A sealing flap projects transversely outwardly from each side of the rectilinear, uppermost opening 65 in the transitional connector 48. As such, the four flaps 68, 69, 70 and 71 extending outwardly from the four sides of the rectilinear opening 65 of the transitional connector 48 will eventually fold to provide a sealing engagement with corresponding sides of the chimney just below the flue liner 12.

The seal between the flaps 68–71 and the chimney is enhanced by interposing a gasket 72 therebetween. Specifically, a heat and fire resistant material such as fiberglass may be employed. One may, if it is desired, utilize four individual bats of such gasket material, one secured to each of the individual flaps 68–71. However, the facility with which the positive interconnect system 10 is installed is at least modestly enhanced if one employs a single, rectilinear gasket 72 provided with a central opening that dimensionally conforms to the uppermost opening 65 of the transitional connector 48. Thus, rather than having four individual bats, each side of one, continuous gasket may be disposed to overlie one of the four sealing flaps 68–71. Each side of the gasket may then be retained in its position with respect to its respective flap by means of a tie 74 provided in conjunction with each said sealing flap.

The ties are each of relatively thin metal that can be easily bent. As such, one end 75 of each tie 74 is secured to the interior surface 76 of the chamber 78 within the connector 48. It is the chamber 78 that effects the transition from the rectilinear uppermost opening 65 of the transitional connector 48 to the generally rectangular lowermost opening 79 of the transitional connector 48. The strap portion 80 of each tie 74 is initially disposed so as to lie as closely as possible over the uppermost surface of the respective flap 68-71 with which it is associated in order to facilitate passage of the transitional connector 48 through the damper opening 29. After the transitional connector 48 has been inserted into the smoke chamber 28 the strap portions 80 of each tie 74 may be bent to extend axially upwardly with respect to the connector 48. In that position the strap portions 80 of the ties 74 may be inserted through the central aperture of the gasket 72, and when the gasket is positioned closely to overlie the uppermost surface of each of the four flaps 68–71 the strap portions 80 may each be bent over the appropriate side of the gasket 72 to secure the gasket in its desired position. For reasons hereinafter more fully explained, that flap 71 which will be disposed toward the rear of the flue when the composite connector 45 is installed has a narrower transverse dimension than do the other three flaps 68–70.

The transitional chamber 78 is formed by four walls 81–84. The uppermost opening 65 is generally rectilinear; in the normal embodiment depicted, the uppermost opening is square. As such, the opposed walls 81 and 83 converge as they extend downwardly from the square opening 65 to define opposed sides of the lowermost opening 79, and conversely, the other set of opposed walls 82 and 84 diverge as they extend downwardly to define the other two, opposed sides of the lowermost opening 79. For convenience, the lowermost opening will generally be rectangular. A rectangular opening 79 constitutes the geometric configuration that can be most easily achieved by the intersection of the four planar walls 81–84, and yet the rectangular opening 79 conforms sufficiently with the oval opening 51 through the connector 46 to provide the desired communication between the two connectors 46 and 48.

A foot flange 85 extends outwardly from each side of the lowermost opening 79, the four foot flanges preferably lying within a common plane. As such, the two opposed foot flanges 85A and 85B extending outwardly from the longer sides of the lowermost opening 79 are receivably insertable within the slideway 52 to effect a joinder of the two connectors 46 and 48. When the foot flange 85C is fully seated beneath the stop flange 56, the interlock 49 may be applied to secure the joinder.

Before describing the interlock 49, however, it must also be appreciated that in order to install the transitional connector 48 the maximum dimension permissible for the overall depth thereof can also not exceed the minor dimension of the damper opening 29, and, in fact should be at least modestly less than the minor dimension of the damper opening in order to facilitate passage of the entire transitional connector 48 through the damper opening 29.

For universality, it is preferable that the overall depth of the transitional connector 48 be less than smallest minor dimension for a damper opening one would expect to encounter in the field. As heretofore explained, therefore, the overall depth of the transitional connector 48 should be no more than approximately 4.5 inches (11.43 cm). Here, too, in order to obviate any possible misunderstanding it should be understood that when speaking of the overall depth, that terminology is intended to signify the maximum dimension between the upper surface of the strap portions 80 of the ties 74, as they closely overlie the sealing flaps 68–71, and the lowermost surfaces of the foot flanges 85.

The interlock 49 has a tongue portion 88 that extends perpendicularly outwardly from the body portion 89 thereof. The tongue portion 88 is slidably received within the open end 60 of the slideway 52 so as closely to overlie the foot flange 85D that spans the open end 60 of the slideway 52. With the body portion 89 of the interlock 49 lying in juxtaposition with the tie plate 58 the tab ends 90 and 91 of the body portion 89 are folded behind the tie plate 58 to embrace the tie plate between the body portion 89 and the tab ends 90 and 91. With the interlock 49 also being made of sheet metal the tab ends 90 and 91 may be readily folded by hand.

With the body portion 89 of the interlock 49 thus lying in juxtaposition with the tie plate 58, a slot 92 that penetrates the body portion 89 of the interlock 49 registers with respect to the conforming slot 61 that penetrates the tie plate 58. The purpose of the aforementioned slots 61, 62 and 92 will hereinafter be described.

Figure 4:
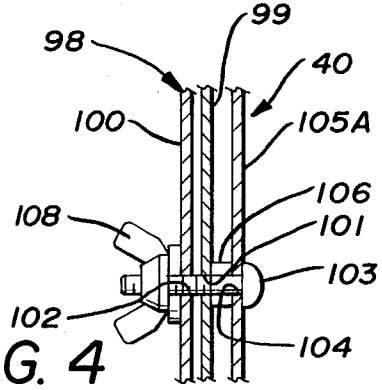
FIG. 4 is an enlarged cross section taken substantially on line 4—4 of FIG. 1 and appearing on the same sheet of drawings as FIG. 3.

As heretofore mentioned, the uppermost end 95 of the flexible duct 40 matingly receives the oval tube 64. The fit is preferably friction tight, but in order to assure that the fit will be maintained during the installation procedure as well as during the ultimate use of the positive interconnect system 10, a pair of U-shaped retainer straps 98, each of which has a pair of parallel legs 99 and 100, are employed to join the composite connector 45 to the corrugated duct 40. One leg 99 of one retainer strap 98A is inserted through the slot 63 (FIG.6). As is best seen in FIG. 4, the outboard ends of the two legs 99 and 100 are provided with registered bores, or elongated slots, 101 and 102.

A bolt 103 is secured through an appropriate bore 104 in the middle of the curved side 105A of the flexible duct 40, as by a hexagonal nut 106, and is received through the registered bores 101 and 102 to be secured by a wing nut 108.

Similarly, one leg 99 of a second retainer strap 98B is inserted through the registered slots 61 and 92. The outboard ends of the two legs 99 and 100 of this second retainer strap 98 are also provided with registered bores, or elongated slots, 101 and 102. The bolt 103, which is secured through the appropriate bore 104 in the middle of the curved side 105B of the flexible duct 40, is received through the registered bores 101 and 102 of the second retainer strap 98 and secured thereto by a wing nut 108.

The retainer straps 98 thus maintain the joinder of the flexible duct 40 to the composite connector assembly 45 not only during installation but also during the entire time that the positive interconnection assembly 10 is deployed within the chimney 14.

With the flexible duct 40 thus secured to the composite connector assembly 45 the assembly 45 may be positioned at the uppermost extent of the smoke chamber 28. So positioned the uppermost opening 65 of the transitional connector 48 communicates with the flue 13 circumscribed by the liner 12 in chimney 14, and the flaps 68–71 are folded back such that the gasket 72 effects the desired seal between the composite connector assembly 45 and the flue liner 12. In that position the lowermost end 110 of the flexible duct 40 extends downwardly through the damper opening 29 operatively to communicate with the insert connector 35, as hereinafter more fully described.

However, before describing the joinder of the flexible duct 40 to the insert connector 45 it should be understood that with the composite connector assembly 45 sealingly engaging the flue liner 12 that position can be secured by a pair of supporting posts 111 and 112. Each supporting post comprises a length of thin walled, tubular conduit 113 within which is received a threaded rod 114. A wing nut 115 is threaded onto the rod 114. With the tubular conduit 113 of each supporting post received over one of the aligning pins 63 the rod 114 is extended until it firmly engages the lower lip 116 on the frame 21 surrounding the damper opening 29. In that position the wing nut 115 is turned until it engages the conduit 113, thus fixedly securing the composite connector assembly 45 in sealed communication with the flue liner 12.

The lowermost end 110 of the flexible duct 40 is matingly received within the boot 120 of the insert connector 35. The insert connector 35 has a rectangular frame 121, the internal dimensions of which are chosen to fit over the standard exhaust vent 122 of a fireplace insert 11. Typically, the vents 122 are of such a size that if the internal dimensions of the frame 121 are equal to, or greater than 4 by 14 inches (10.16 by 35.56 cm) the insert connector 35 will fit over the exhaust vent 122 of virtually any insert 11 presently on the market. The boot 120, which is of oval cross sectional configuration in order matingly to engage the flexible duct 40 as it is received therein, terminates, at its lower extremity, in a planar, peripheral foot flange 123 that slidingly engages the upper face 124 of the rectangular frame 121. The foot flange 123 is retained in its position by a cover plate 125. The cover plate has a peripheral skirt portion 126 that extends downwardly over, and conforms to the peripheral, outer side walls 128 of the frame 121, and a pair of nut and bolt combinations 129 secure the cover plate 125 to the frame 121. The foot flange 123 of the boot 120 is slidingly retained between the upper surface 124 on the frame 121 and the cover plate 125. The frame 121 has a central aperture 130 which registers with a corresponding aperture 131 in the central portion of the cover plate 125. The fore and aft dimension of the boot 120 is preferably less than the corresponding dimension of the apertures 130 and 131 in order to permit the boot 120 to slide fore and aft, as necessary or desirable, for the most suitable alignment of the boot 120 with the exhaust vent 122 of the insert 11. The foot flange 123 is of such dimension, relative not only to the two apertures 130 and 131 but also to the outer dimensions of the frame 121, that the boot 120 can move across the full span of apertures 130 and 131 and yet the foot flange 123 will maintain the apertures 130 and 131 closed to the passage of exhaust gases other then through the boot 120.

Inside or outside fastener means 135 or 136, respectively, may be employed to secure the insert connector 35 to the fireplace insert 11 in order to provide a choice for the convenience of the installer. The inside fastener 135 is particularly adapted for use in conjunction with those installations where the exhaust vent 122 extends upwardly of the unit 11 to such an extent that an adequate purchase can be readily obtained against the inside of the exhaust vent 122 by the lock arms 146 and 148, as depicted in FIG. 2. On the other hand, in those situations where the exhaust vent 122 extends only a short distance upwardly of the insert 11, such that the insert connector 35 can rest on the unit 11 itself, as depicted in FIGS. 1 and 6, the outside fastener 136 can be employed with particular facility.

Turning, then, to a description of the inside fastener means 135, as is best seen in FIG. 2, a support bar 138 spans between two opposed sides 139 and 140 of the insert connector frame 121. The opposite ends 141 and 142 of the support bar 138 are disposed perpendicularly to the bar 138 and extend outwardly therefrom in opposite directions in order to impart stability to the bar 138 merely by the use of a pair of nut and bolt combinations 129. The upper end portion 143 of a link 144 is pivotally secured to the medial portion of the support bar 138, as by another nut and bolt combination 145. The lower end portion is, in turn, pivotally connected to lock arms 146 and 148, as by a nut and bolt combination 149.

The lock arm 146 comprises a straight piece of flat bar stock, one end of which may be bevelled, as at 150, in order to assure that the contact tip 151 will be able to engage the interior of the exhaust vent 122 without being displaced. The body portion 152 of the lock arm 148 lies in contiguous juxtaposition with the lock arm 146, and the flange end 153 of the lock arm 148 extends perpendicularly outwardly of the body portion 152 in a direction away from the contiguous lock arm 146. A set bolt 155 is threadably received within a bore through the flange end 153 and may be selectively secured by a pair of lock nuts 159 and 160 that are threaded onto the set bolt 156 lockingly to embrace the opposite sides of the flange end 153. The insert connector 35 may thus be secured to the insert 11 by engagement of the opposed contact tip 151 of the lock arm 146 and the pointed end 161 of the set bolt 155 with the interior surface 162 of the exhaust vent 122.

As best seen in FIG. 1, the outside fastener means 136 each comprise a a pair of angle brackets 165 and 166. The angle bracket 165 has a first, or upright, leg 168 that is provided with a bore whereby the bracket 165 can be secured to the insert connector 35 by virtue of the nut and bolt combination 129. The second, or horizontal, leg 170 is provided with an elongated slot 171 whereby to effect the hereinafter described adjustable connection of the angle bracket 165 to the angle bracket 166.

The angle bracket 166 has a first, or horizontal, leg 172 that underlies the leg 170 of the angle bracket 165. The leg 172 is provided with a bore, the underside of which is preferably countersunk to receive the flat head 174 (FIG. 6) of a bolt 175. The bolt 175 extends upwardly from the first leg 172 of bracket 166 to be received through the elongated slot 171 in the second leg 170 of the angle bracket 165. A wing nut 176 is threaded onto the bolt 175 to permit the installer of the system 10 to secure the relative position of the overlapping legs 170 and 172 merely by tightening the wing nut 176. The second, or vertical, leg 178 of the angle bracket 166 serves as the gripping member of the outside fastener means 136, and as such it frictionally engages the side of the insert 11.

INSTRUCTIONS FOR INSTALLATION

Before installation is begun one should be assured that the walls of the smoke chamber 28, including the shelf 25, as well as the chimney are properly cleaned and free of excessive soot and/or creosote. Thereafter, one should take few minutes to make certain that all parts are at hand and that all pre-installation preparations have been completed.

List of Parts

The necessary parts are:

One oval connector 46;

One transitional connector 48;

One interlock 49;

A gasket 72 of heat and fire resistant material;

two bolts 103, as well as one hexagonal nut 106 and one wing nut 108 for each;

Two retainer straps 98;

One length of flexible, oval ducting 40;

Two lengths of electrical type conduit pipe 113;

Two threaded rods 114, each with a wing nut 115 that has been started onto one end of the rod;

One insert connector 35;

One internal and/or one external fastener 135, 136 for the insert connector 35;

Pre-preparation of Parts

1. Drill two holes 104 an appropriate distance from that end 95 of the flexible duct 40 that will be inserted upwardly through the damper opening 29. One hole is to be drilled in the middle of each of the two curved sides 105A and 105B of the flexible duct 40.

2. The nuts 103 are to be inserted through those holes 104 with the heads of the bolts located on the inside of the flexible duct 40. Each bolt 103 is to be firmly secured in place by one of the hexagonal nuts 106.

3. The two retainer straps 98A and 98B, if they aren't already, are to be folded in half so the bores 101 and 102 in each leg 99 and 100 are generally aligned.

4. Remove the damper plate (not shown) from the opening 29.

Actual Installation

Figure 7A:
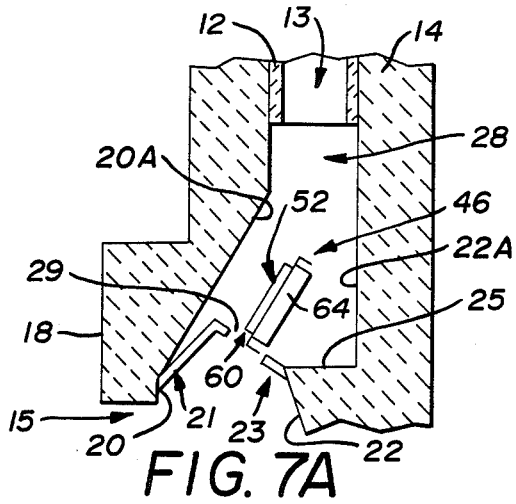

The oval connector 46 is preferably first inserted through the damper opening 29 and oriented in the smoke chamber 28 with the oval tube 64 extending downwardly and with the flat, flanged slideway 52 facing upwardly, as depicted in FIG. 7A. The open end 60 of the slideway 52 must face the damper opening 29.

Figure 7B:
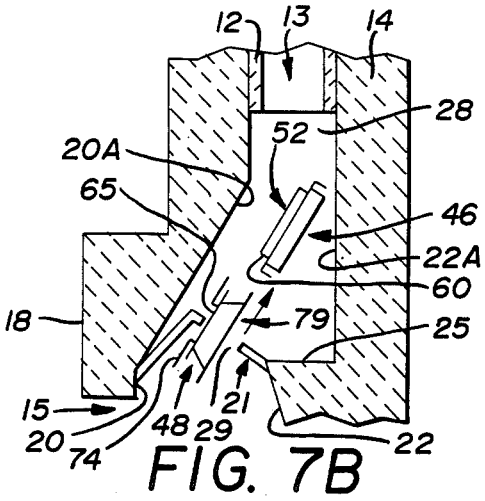

The transitional connector 48 is preferable then inserted through the damper opening 29, as depicted in FIG. 7B, with the rectangular opening 79 facing downwardly and with the square opening 65 facing upwardly. The foot flanges 85A and 85B on the lateral sides of the downwardly facing rectangular opening 79 slid into the open end 60 of the slideway 52 on the oval connector 46.

When the foot flange 85C is fully seated under the stop flange 56, the tongue portion 88 of the interlock 49 is inserted into the open end 60 of the slideway 52, to overlie the exposed foot flange 85D, and the tab ends 90 and 91 of the interlock 49 are folded around, and behind, the edges of the adjacent tie plate 58 on the oval connector 46.

The gasket 72 is centered with respect to the the upwardly directed opening 65 of the transitional connector 48, and thus overlies the sealing flaps 68–71 thereof. The gasket 72 is secured in place by bending the strap portions 80 of the ties 74 associated with each sealing flap 68–71 over the gasket 72.

One leg 99 of one retainer strap 98 is inserted completely through the slot 62 in the tie plate 59 on one end of the oval connector 46, and one leg 99 of the other retainer strap 98A is inserted completely through the slot 61 in the other tie plate 58 as well as the slot 92 in the interlock 49.

Figure 7C:
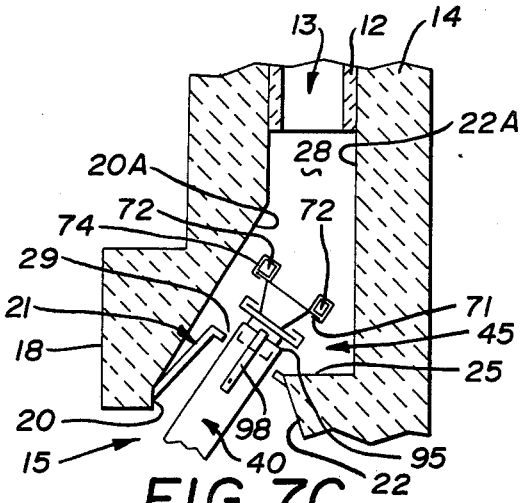

The thus joined connectors 46 and 48 comprise the composite connector assembly 45 which is then turned within the smoke chamber 28 so that the narrowest sealing flange 71 is directed generally rearwardly toward wall 22A of the smoke chamber 28 with the oval tube 64 extending partially through the damper opening 29, as depicted in FIG. 7C.

What is to be the uppermost end 95 of the flexible duct 40 is matingly engaged with the oval tube 64, and the bores 101 and 102 in the ends the legs 99 and 100 of the retainer straps 98 and 98A are received over the bolts 103 mounted in the curved sides 105 and 105A of the flexible duct 40. The wing nuts 108 are then applied to secure the straps 98 and 98A to the flexible duct 40.

Figure 7D:
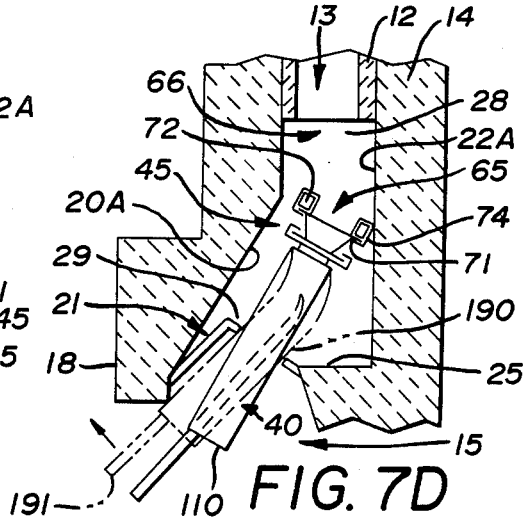

The flexible duct 40 is fed upwardly through the damper opening 29 until the narrowest sealing flange 71 engages the rear wall 22A of the smoke chamber 28 (FIG. 7D). That flange 71 which is intended to so engage the rear wall 22A of the smoke chamber was purposely made to be the narrowest in order to provide that flange 71 with the greatest resistance to buckling.

The hereinafter described method by which to effect the required bend in the flexible duct 40 effects a considerable columnar load upon the flange 71, and that load could easily buckle the flange 71 were the flange 71 too long to resist the compressive stress applied thereto by the columnar loading. In technical terms, the narrow dimension of the flange 71 decreases the L/R ratio, thereby increasing the ability of the flange 71 to resist columnar buckling.

The curved end 190 of the special forming bar 191 is inserted into the lowermost end 110 of the flexible duct 40 and used as a pry to initiate the required bending of the flexible duct 40.

Figure 7E:
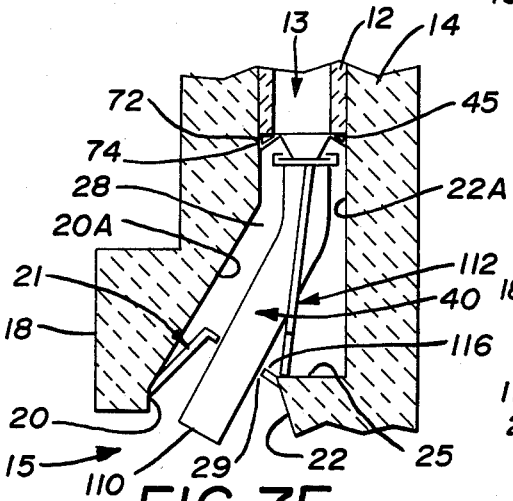

Continued insertion of the now initially bent, flexible duct 40 through the damper opening 29 folds all four sealing flanges 68–71, as required, to force the gasket 72 into sealing engagement with the flue liner 12, and the surrounding environs, and thereby assure that only the flexible duct 40 communicates with the chimney 14 (FIG. 7E).

Irrespective of whether the gasket 72 comprises a one piece, rectangular, frame-like member or four individual bats, it is highly desirable that the folding of the four sealing flanges 68–71 be accomplished in such a way as to prevent the flanges from binding or cutting the gasket 72. This result can be achieved by providing means to assure that each flange will slide either above or below the adjacent flanges. The wing guides 180 and 181 which extend outwardly from the flange 68 to underlie flanges 69 and 71, respectively, in combination with the similar wing guides 182 and 183 which extend outwardly from the flange 70 to underlie the respective flanges 69 and 71 provide a preferred means by which to accomplish this result.

To retain this position the conduit pipes 113 are each cut several inches shorter than the distance between the underside of the generally planar frame portion 50 of the oval connector 46 and the lip 116 of the damper frame 21.

One end of each conduit pipe 113 is positioned over one aligning pin 63 at either end of the oval opening 51 through the connector 46, and a threaded rod 114 is inserted in the other end of each conduit 113. The wing nut 115 is turned to force each threaded rod 114 outwardly of its respective conduit 113 and firmly against the lip 116 of the damper frame 21. One such arrangement on each side of the flexible duct 40 will secure the entire assembly heretofore described firmly against the lowermost flue liner 12 in the chimney 14.

It should be appreciated that the lengths of conduit 113, or the like, may also be employed to insert the composite connector assembly 45 upwardly into position against the flue liner 12. The provision of fairly substantial aligning pins 63 assures that the conduit 113 will not move laterally out of position relative to the composite connector assembly 45 during installation of the system 10.

Figure 7F:
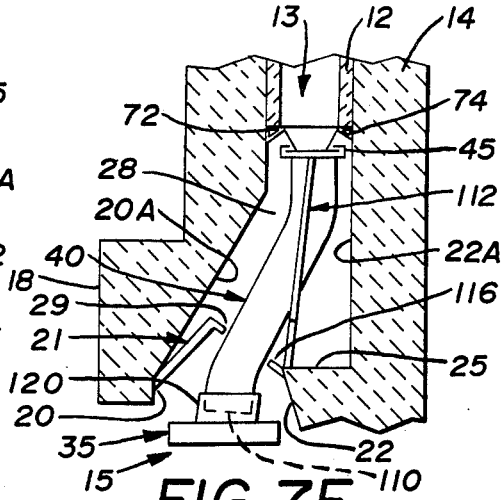

With the components secured in position to this point the length of the flexible duct 40 may once again be checked, and if it is too long for convenience, it may be cut to the desired length as it hangs free through the damper opening 29. With the flexible duct 40 cut to a suitable length the lowermost end 110 thereof is inserted into the boot 120 of the insert connector 35 (FIG. 7F).

At this point in the installation procedure the installer selects, at his/her preference, whether an inside fastener 135 or an outside fastener 136 is the desired means by which to secure the insert connector 35 to the fireplace insert 11. If the inside fastener 135 is selected, it is mounted within the insert connector 35 before the insert 11 is positioned within the recess 15.

Because the inside fastener 135 can be pivoted from its extended position, as depicted in FIG. 2, to a retracted position, where it lies wholly disposed within the insert connector 35, by virtue of the link 143, it will not prevent the insert connector 35 from being positioned closely above the uppermost extent of the exhaust vent 122 as the insert 11 is slid into a position where the insert connector 35 can be received downwardly around the exhaust vent 122. In this partially inserted position the installer can reach inside the insert 11, extend the inside connector 135 downwardly within the vent 122 and secure the connection by engaging the contact tip 151 of the lock arm 148 against one side of the interior surface 162 of the exhaust vent 122 and then turning the set bolt 155 so that the pointed end 161 thereof engages the opposite side of the interior surface 162 within the exhaust vent 122.

With the insert connector secured to the insert 11, the latter may be disposed in its final position within the fireplace recess 15.

It should now also be apparent that should the installer elect to employ the outside fastener means 136, the insert can be similarly positioned to receive the insert connector 35 over the exhaust vent 122, in which position the first leg 168 of each angle bracket 165 is secured to the sides of the insert connector 35. The angle brackets 166 are thereafter slid into position with the second leg 178 of each angle bracket 166 engaging the exterior side wall of the insert and the wing nuts 176 are tightened to secure the insert connector 35 to the insert 11.

This completes the description of a positive interconnect system 10, embodying the concepts of the present invention, and extending between the exhaust vent 122 of a fireplace insert 11 in the flue liner 12 of the chimney 14. It should now be apparent that any shroud (not shown) employed between the facing 18 of the fireplace and the insert 11 will strictly be for purposes of decoration; Such a shroud will serve no sealing function and can, therefore, be rather easily positioned by means well known to those skilled in the art.

All considered, it should now also be apparent that the herein described construction provides a positive interconnect system in the nature of a sealed passageway that extends between the fireplace insert and the flue liner without being supported from the damper. The system can readily accommodate wide dimensional variations in the structural environment in which it is installed, can be manufactured and installed relatively inexpensively, can, for the most part, be installed with standard hand tools, and can clearly otherwise accomplish the objects of the invention.

I claim:

1. A positive interconnect system for a fireplace insert having an exhaust vent, the insert to be received within a fireplace having a damper frame and a flue liner which terminates upwardly of a smoke chamber provided between the damper frame the lowermost extend of the flue liner within a chimney;

a composite connector assembly having first and second end openings;

the first end opening of said composite connector assembly having dimensions that substantially correspond with the dimensions of the flue opening of the lowermost extent of the liner; means presented from said first end opening of said composite connector assembly to effect a sealing engagement with the lowermost extent of the flue liner;

a flexible duct having upper and lower end openings;

the second end opening of said composite connector assembly being adapted to communicate with the upper end opening of said flexible duct;

an insert connector;

the lower end opening of said flexible duct communicating with said insert connector; and, fastening means by which to secure said insert connector in communication with the exhaust vent of the insert.

2. A positive interconnect system, as set forth in claim 1, wherein said composite connector assembly comprises:

an oval connector;

a transitional connector; and, means selectively to join said oval connector to said transitional connector.

3. A positive interconnect system, as set forth in claim 2, wherein:

one said connector is provided with a slideway;

the other said connector is provided with foot flanges;

said foot flanges being selectively receivable within said slideway in order to join said oval connector to said transitional connector.

4. A positive interconnect system, as set forth in claim 3, wherein:

means are provided selectively to lock said foot flanges within said slideway.

5. A positive interconnect system, as set forth in claim 2, wherein:

said oval connector is provided with a slideway;

said transitional connector is provided with foot flanges;

said foot flanges being selectively receivable within said slideway in order to join said oval connector to said transitional connector; and, an interlock selectively to secure said foot flanges within said slideway.

6. A positive interconnect system, as set forth in claim 5, wherein said oval connector comprises:

a planar frame;

a pair of retainer flanges extending laterally along said planar frame;

a stop flange presented at one end of said slideway;

an open access at the other end of said slideway; and, a tie plate at the open access end of said slideway and extending downwardly away from said open access end.

7. A positive interconnect system, as set forth in claim 6, wherein said interlock comprises:

a body portion;

a tongue portion extending transversely outwardly of said body portion;

a tab presented from at least one lateral end of said body portion;

said interlock being selectively positioned with said body portion disposed in contiguous juxtaposition with respect to said tie plate and with said tongue portion overlying at least one foot flange within said slideway; and, said tab being foldable to embrace said tie plate between said tab and said body portion.

8. A positive interconnect system, as set forth in claim 7, wherein:

a second tie plate is located adjacent said stop flange and extends downwardly from said stop flange;

a slot is provided in said second tie plate;

said first tie plate and the body portion of said interlock are provided with registered slots;

retainer strap means are received through said slots and are fastened to said flexible duct whereby to secure said flexible duct to the said composite connector assembly.

9. A positive interconnect system, as set forth in claim 8, wherein:

flaps extend outwardly from the the first end opening of of said composite connector assembly;

gasket means are carried on said flaps;

said flaps being foldable with respect to the remainder of said composite connector assembly in order to effect a seal between said composite connector assembly and the flue liner.

10. A positive interconnect system, as set forth in claim 9, wherein:

means are provided to preclude adjacent flaps not only from binding but also from cutting said gasket.

11. A positive interconnect system, as set forth in claim 9, wherein:

wing guides extend outwardly from selected flaps slidably to engage adjacent flaps and thereby preclude the said flaps from binding, one against another, but also from cutting said gasket.

12. A positive interconnect system, as set forth in claim 9, wherein:

one said flap is narrower than the remainder of said flap.

13. A positive interconnect system, as set forth in claim 9, wherein:

deformable ties are carried by said composite connector assembly, said ties being bendable over said gasket means to secure said gasket means to said flaps.

14. A positive interconnect assembly, as set forth in claim 13, further comprising:

post means;

said post means having a tubular member and an extension means;

said tubular member having upper and lower ends;

at least one aligning pin extends downwardly from the planar frame of said oval connector;

the upper end of said tubular member operatively engaging said aligning pin;

a portion of said extension means being received in the lower end of said tubular member;

that portion of said extension means not received within said tubular member selectively extensible firmly to engage the fireplace structure; and, means to secure said extension means relative to said tubular member.

15. A positive interconnect system, as set forth in claim 4, wherein:

the damper frame has a damper opening;

said damper opening having a major and a minor dimension, the minor dimension being the lesser dimension and thereby effectively controlling the size of any object that can be passed through said damper opening;

the said oval connector and the said transitional connector each having individual overall depths;

the overall depth of said oval connector and the overall depth of said transitional connector each being less that the minor dimension of said damper opening.

16. A positive interconnect system, as set forth in claim 15, wherein:

said transitional connector has a rectilinear end opening, the rectilinear end opening of said transitional connector constituting the first end opening of said composite connector assembly;

said transitional connector also has a rectangular end opening;

said oval connector has a rectangular end opening;

the said rectangular end openings of said transitional connector and said oval connector being in registered communication when the foot flanges on the one said connector are received within said slideway on the other said connector;

said oval connector also has a generally oval lower end opening, said lower end opening of the oval connector constituting the second end opening of said composite connector assembly.

17. A positive interconnect system, as set forth in claim 16, wherein:

flaps extend outwardly from the sides of the rectilinear opening of said transitional connector;

gasket means are carried on said flaps; said flaps being foldable with respect to the remainder of said transitional connector in order to effect a seal between said transitional connector and the flue liner.

18. A positive interconnect system, as set forth in claim 17, wherein:

deformable ties are carried by said transitional connector, said ties being bendable over said gasket means to secure said gasket means to said flaps.

19. A positive interconnect system, as set forth in claim 18, wherein:

retainer strap means secure said flexible duct to said composite connector assembly.

20. A positive interconnect system, as set forth in claim 19, further comprising:

post means;

said post means having a tubular member and an extension means;

said tubular member having upper and lower ends;

at least one aligning pin extends downwardly from said composite connector assembly;

the upper end of said tubular member operatively engaging said aligning pin;

a portion of said extension means being received in the lower end of said tubular member;

that portion of said extension means not received within said tubular member selectively extensible firmly to engage the fireplace structure; and, means to secure said extension means relative to said tubular member.

21. A positive interconnect system, as set forth in claim 1, wherein the insert connector comprises:

a frame adapted to receive the exhaust vent of a fireplace insert;

a boot carried on said frame and selectively positionable with respect thereto;

said flexible duct communicating with said boot; and, fastener means to secure said frame to the fireplace insert.

22. A positive interconnect system, as set forth in claim 21, wherein:

said boot presents a foot portion that slidably engages said frame to effect the relative positioning thereof.

23. A positive interconnect system, as set forth in claim 22, wherein:

a cover plate maintains said foot portion in sliding engagement with said frame.

24. A positive interconnect system, as set forth in claim 23, wherein:

said frame and said cover plate have registered, central apertures; and, the dimensions of said central apertures are greater that the corresponding dimensions of said boot in order to permit said boot to be slidably positioned with respect to said apertures.

25. A positive interconnect system, as set forth in claim 24, wherein:

the dimensions of said foot portion are greater than the corresponding dimensions of said apertures and less than the corresponding dimensions of said frame in order that said foot portion will maintain said apertures closed to the passage of exhaust gasses, except through said boot.

26. A positive interconnect system, as set forth in claim 25, wherein said fastener means comprises:

at least one pair of interengaged angle brackets which are secured to the frame of said insert connector and frictionally engage the exterior of said fireplace insert.

27. A positive interconnect system, as set forth in claim 25, wherein said fastener means comprises:

a support bar carried from said frame;

a link having opposed ends;

one end of said link being pivotally carried from said support bar;

a pair of lock arms;

said lock arms pivotally carried from the other end of said link; and, a set bolt presented from one said lock arm to effect engagement with the interior of the exhaust vent in opposition with the other said lock arm.

28. A method for installing a positive interconnect system between the exhaust vent of a fireplace insert and the flue liner of a chimney having a damper opening and a smoke chamber, comprising the steps of:

inserting an oval connector through the damper opening and into the smoke chamber;

inserting a transitional connector through the damper opening and into the smoke chamber;

connecting said oval connector to said transitional connector within said smoke chamber to form a composite connector assembly;

selectively orienting said composite connector assembly relative to said damper opening;

securing one end of a flexible duct in communication with said composite connector assembly;

inserting said flexible duct through said damper opening to bring said composite connector assembly into sealing engagement with the flue liner; and, operatively connecting the second end of said flexible duct to the fireplace insert.

29. A method for installing a positive interconnect system, as set forth in claim 28, comprising the further steps of:

providing an insert connector;

securing the second end of the flexible duct to said insert connector;

positioning the insert connector in operative position relative to the exhaust vent of the fireplace insert; and, fastening the insert connector to the fireplace insert.

30. A method for installing a positive interconnect system, as set forth in claim 29, comprising the further steps of:

providing a boot for the insert connector;

securing the second end of said flexible duct to said boot; and, selectively positioning the boot relative to the exhaust vent of the fireplace insert.

31. A method for installing a positive interconnect system, as set forth in claim 30, comprising the further steps of:

fastening the insert connector to the exterior of the fireplace insert.

32. A method for installing a positive interconnect system, as set forth in claim 30, comprising the further steps of:

fastening the insert connector to the interior of the exhaust vent on the fireplace insert.

* * * * *